US008620171B2

(12) United States Patent
Izumi et al.

(10) Patent No.: US 8,620,171 B2
(45) Date of Patent: Dec. 31, 2013

(54) TRANSFER DEVICE AND IMAGE FORMING APPARATUS

(75) Inventors: Hideshi Izumi, Osaka (JP); Toshiki Takiguchi, Osaka (JP); Kuniaki Nakano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 358 days.

(21) Appl. No.: 13/161,562

(22) Filed: Jun. 16, 2011

(65) Prior Publication Data

US 2012/0002996 A1 Jan. 5, 2012

(30) Foreign Application Priority Data

Jun. 30, 2010 (JP) ..... 2010-148421

(51) Int. Cl.
*G03G 15/16* (2006.01)

(52) U.S. Cl.
USPC ..... 399/66; 399/101

(58) Field of Classification Search
USPC ..... 399/66, 98, 99, 101, 314
See application file for complete search history.

(56) References Cited

U.S. PATENT DOCUMENTS

| | | | | |
|---|---|---|---|---|
| 7,486,900 | B2 * | 2/2009 | Omata | 399/49 |
| 2008/0317495 | A1 * | 12/2008 | Hyakutake et al. | 399/101 |
| 2009/0136257 | A1 * | 5/2009 | Hattori et al. | 399/111 |
| 2009/0324278 | A1 * | 12/2009 | Tomura et al. | 399/101 |

FOREIGN PATENT DOCUMENTS

| | | | |
|---|---|---|---|
| JP | 2-167585 | A | 6/1990 |
| JP | 6-175509 | A | 6/1994 |
| JP | 2005-115327 | A | 4/2005 |
| JP | 2006-323296 | A | 11/2006 |
| JP | 2006-337578 | A | 12/2006 |
| JP | 2007-72376 | A | 3/2007 |
| JP | 2007-94343 | A | 4/2007 |

* cited by examiner

*Primary Examiner* — Walter L Lindsay, Jr.
*Assistant Examiner* — Rodney Bonnette
(74) *Attorney, Agent, or Firm* — Birch, Stewart, Kolasch & Birch, LLP

(57) ABSTRACT

A transfer device includes a transfer belt, a transfer roller and a tension roller over which the transfer belt is passed in a tensioned condition and which is made to be in an electrically floated state; it also includes a guide member that is installed in the vicinity of the tension roller. A control section, in transfer processing, controls a first switch so that the guide member is in a grounded state while controlling a second switch so that an electric current being caused to flow to the transfer roller becomes a first electric current; and in cleaning processing, controls the first switch so that the guide member is in an electrically floated state while controlling the second switch so that an electric current being caused to flow to the transfer roller becomes a second electric current.

6 Claims, 8 Drawing Sheets

TRANSFER DEVICE AND IMAGE FORMING APPARATUS

CROSS REFERENCE

This Nonprovisional application claims priority under 35 U.S.C. §119(a) on Patent Application No. 2010-148421 filed in Japan on Jun. 30, 2010, the entire contents of which are hereby incorporated by reference.

BACKGROUND OF THE INVENTION

The present invention relates to a transfer device provided with a guide member for restricting a conveyance direction of a recording material and to an image forming apparatus.

Among image processing apparatus, there are ones that are configured so as to transfer a toner image formed in an image forming section onto a recording paper sheet by a transfer device and then so as to guide the recording paper sheet to a fuser unit with a paper guide. Among such kind of image forming devices, there have conventionally been ones in which in transfer processing a stain is removed from a surface of a transfer belt by a cleaner (cleaning blade) provided in the transfer device, because unnecessary toner such as fog toner sticks to the transfer belt in transfer processing (for instance, refer to Japanese Patent Unexamined Publication No. 2007-94343 bulletin).

However, in such a conventional image forming apparatus as described in the Japanese Patent Unexamined Publication No. 2007-94343 bulletin, since the cleaner is always kept in contact with the transfer belt, there have been problems that the transfer belt elongates with the passage of time, thereby resulting in the occurrence of wrinkles and/or meandering, and/or that the transfer belt is damaged.

Then, in order to solve such problems, it is possible to conceive an image forming apparatus in which a transfer device, which is not provided with a cleaner, causes unnecessary toner to adhere from the secondary transfer belt to a primary transfer belt and then to be collected by a cleaner for the primary transfer belt. This sort of image forming apparatus has, for example, a configuration like an image forming apparatus 200 shown in FIGS. 1, 2.

In transfer processing, as shown in FIG. 1, the image forming apparatus 200, by causing a switch 621 to change over, connects a first power supply 622 to a primary transfer belt drive roller 62, and causes a first electric current (for instance, minus 40 microamperes) to flow from a primary transfer belt drive roller 62 to a secondary transfer roller 312. By this procedure, a difference in electric potential occurs between a primary transfer belt 6 and a paper sheet P, so that a toner image that is borne on the primary transfer belt 6 undergoes a secondary transfer onto the paper sheet P due to an electrostatic force.

In cleaning processing, as shown in FIG. 2, the image forming apparatus 200, by causing the switch 621 to change over, connects a second power supply 623 to the primary transfer belt drive roller 62, and causes a second electric current that is smaller in absolute value than the one in transfer processing to flow from the primary transfer belt drive roller 62 to the secondary transfer roller 312. Because most part of the unnecessary toner on the secondary transfer belt 310 is fog tonner that has a small quantity of electrostatic charges, a moderate difference in electric potential occurs between the primary transfer belt 6 and the secondary transfer belt 310 when the second electric current (for instance, minus 10 microamperes) that is smaller in absolute value than the one in transfer processing is caused to flow; so that the unnecessary toner on the secondary transfer belt 310 adheres to the primary transfer belt 6 due to an electrostatic force, and then the unnecessary toner is collected by the primary transfer belt cleaning unit (not shown).

Therefore, in the image forming apparatus 200, neither a wrinkle, damage nor the like occurs to the secondary transfer belt 310; also, unnecessary toner can be removed from the secondary transfer belt 310.

However, in the image forming apparatus 200, because of the three possible causes as described below, there is a problem that in cleaning processing for the secondary transfer unit 31 an electrical discharge noise occurs between the secondary transfer belt drive roller 313 and a pre-fusing guide member 18 due to an electrical discharge phenomenon.

Cause 1: The secondary transfer belt drive roller 313 in an electrically floated state (a floating state) becomes a high voltage (for instance, 2.2 kV).

Cause 2: The pre-fusing guide member 18 is arranged in the vicinity (for instance, a distance of about 1 mm through 3 mm) of the secondary transfer belt drive roller 313.

Cause 3: The pre-fusing guide member 18 is grounded.

That is, in cleaning processing, since the drive roller 313 is at a high voltage while the grounded pre-fusing guide member 18 is installed in the vicinity of the drive roller 313, the electrical discharge phenomenon occurs between the drive roller 313 and the guide member 18.

As to the Cause 1, the reason why the secondary transfer belt drive roller 313 becomes a high voltage is as follows. That is to say, it is thought to be caused by the electric charges accumulated in excess onto the roller 313 through the secondary transfer belt 310 because an electric current value flowing to the roller 312 is small due to the fact that the second electric current value (absolute value) is small and that the secondary transfer roller 312 has a resistance, and further because the secondary transfer belt drive roller 313 is caused to be in an electrically floated state. When the absolute value of the second electric current value is increased (so as to become close to the first electric current value) in order to avoid the roller 313's state of reaching a high voltage, the electric current value flowing to the secondary transfer roller 312 also increases; consequently, while the voltage of the roller 313 is lowered as the excessive accumulation of electric charges onto the roller 313 ceases to occur, the fog toner on the secondary transfer belt 310 is charged again, thereby being rendered unable to be completely removed. Therefore, the above described second electric current value cannot be increased. After all, Cause 1 cannot be solved.

As to the Cause 2, when the pre-fusing guide member 18 is installed being separated from the secondary transfer belt drive roller 313, there arises a risk that the paper sheet P is rolled up onto the secondary transfer belt 310. Therefore, the Cause 2 is also difficult to solve.

As to the Cause 3, when the pre-fusing guide member 18 is fixed in an electrically floated state (the first countermeasure), it is possible to prevent the aforementioned electrical discharge phenomenon from occurring in cleaning processing. In that case, however, in transfer processing (image forming processing), since remnant electric charges are accumulated onto the pre-fusing guide member 18, image deletion occurs to the toner image on the paper sheet P due to the excessive electrostatic charges that have accumulated, for example, in the course of double sided copying performed onto about 200 paper sheets. Therefore, the Cause 3 is also difficult to solve.

With regard to the Cause 3, the image deletion can be prevented from occurring by having the secondary transfer belt drive roller 313 grounded in addition to having the pre-fusing guide member 18 grounded (the second countermeasure). In that case, however, in transfer processing, since the paper sheet P is diselectrified twice, i.e. first on passing the neighborhood of the secondary transfer belt drive roller 313 and then on touching the pre-fusing guide member 18, an electrostatic adsorption force acting on the toner toward the paper sheet P decreases to a large extent. Therefore, the toner moves on the paper sheet P, thereby resulting in the occurrence of a picture quality disorder.

In this manner, with the image forming apparatus as shown in FIGS. 1, 2, in cleaning processing, facing the problem that the electric discharge noise occurs between the secondary transfer belt drive roller 313 and the pre-fusing guide member 18 is unavoidable. Also, there is a problem that the above described first and/or second countermeasures to avoid the above problem can cause the image deletion and/or the picture quality disorder.

Thus, the present invention is principally directed to providing a transfer device free from an electric discharge noise.

The present invention is also directed to providing a transfer device free from an image deletion and/or a picture quality disorder in a toner image on a paper sheet.

The present invention is further directed to providing an image forming apparatus using the transfer device.

SUMMARY OF THE INVENTION

A transfer device of the present invention comprises:

a transfer unit including a transfer belt for conveying a recording material onto which a toner image is transferred from an image bearing member, a transfer roller formed from a resistive material and disposed opposed to the image bearing member across the transfer belt, the transfer roller being set to be in a grounded state in order to cause an electric current to flow between thereof and the image bearing member, and a tension roller for supporting the transfer belt with tension, the tension roller being set to be in an electrically floated state;

a guide member installed in the vicinity of the tension roller for restricting a conveying direction of the recording material conveyed by the transfer belt;

a first switch for causing the state of the guide member to switch between a grounded state and an electrically floated state;

a second switch for causing an electric current being made to flow from a power supply section to the transfer roller to switch between a first electric current and a second electric current of which absolute value is smaller than that of the first electric current; and a control section for controlling the first switch and the second switch depending on whether the process is a transfer process in which a toner image is transferred from the image bearing member onto the recording material or a cleaning process in which residual toner that is sticking onto the transfer belt is caused to adhere onto the image bearing member for its removal, wherein the control section, in the transfer processing, controls the first switch so that the guide member is in the grounded state while controlling the second switch so that an electric current being caused to flow to the transfer roller becomes the first electric current; and, in the cleaning processing, controls the first switch so that the guide member is in the electrically floated state while controlling the second switch so that an electric current being caused to flow to the transfer roller becomes the second electric current.

In transfer processing, a transfer operation is carried out due to the first electric current of a large absolute value flowing to the transfer roller. At this time, because the tension roller of the transfer unit is in the electrically floated state, occurrence of a picture quality disorder such as toner movement can be prevented at this part.

Besides, in cleaning processing, the second electric current of a small absolute value flows to the transfer roller. At this time, because the tension roller of the transfer unit is in the electrically floated state while the electric current value flowing to the transfer roller, which is a resistive material, is small, the electric charges are liable to accumulate through the transfer belt onto the tension roller. Therefore, the tension roller becomes a high voltage (for instance, 2.2 kV). According to the present invention, however, because the guide member is switched into the electrically floated state, the electric discharge noise can be prevented from occurring between the tension roller and the guide member even when the tension roller becomes a high voltage.

DETAILED DESCRIPTION OF THE INVENTION

Figure 1:
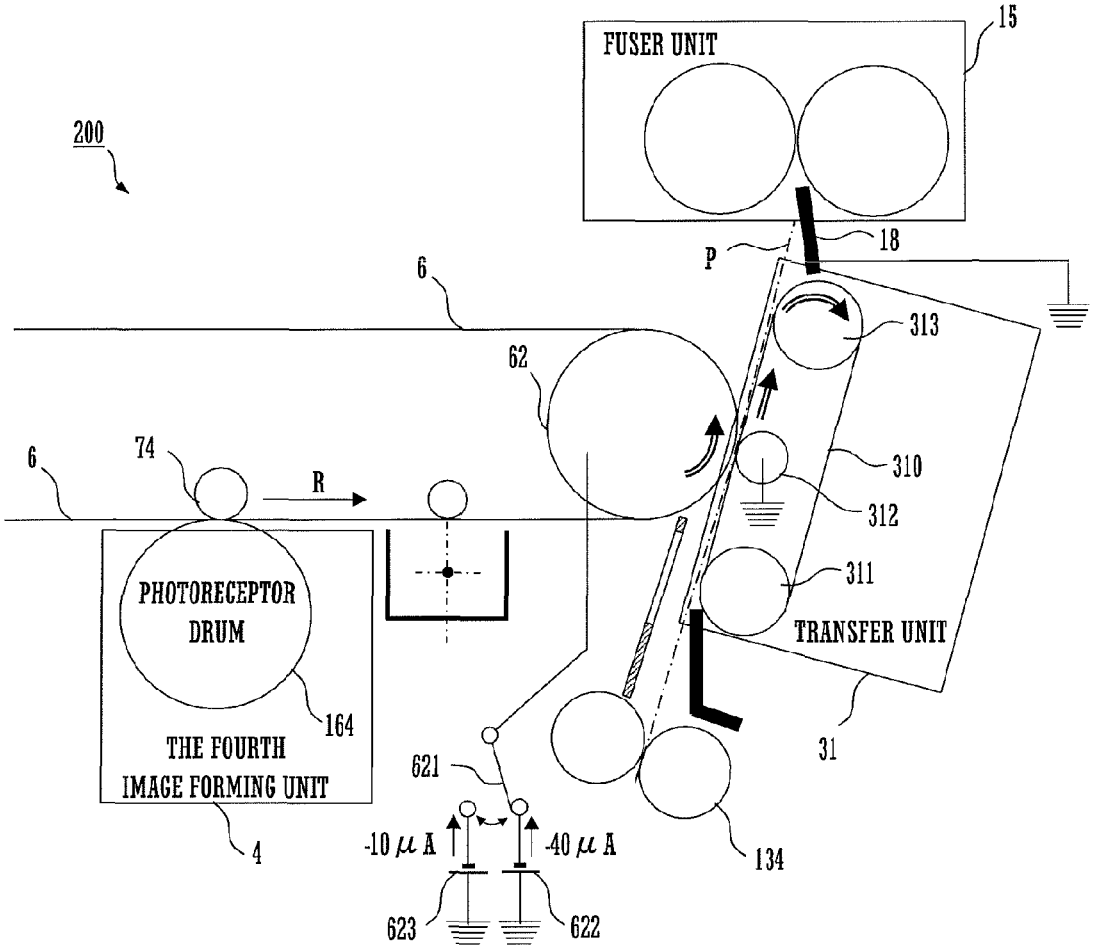
FIG. 1 is a schematic drawing showing a configuration by which a transfer process is performed in an image forming apparatus to which the present invention relates.
Figure 2:
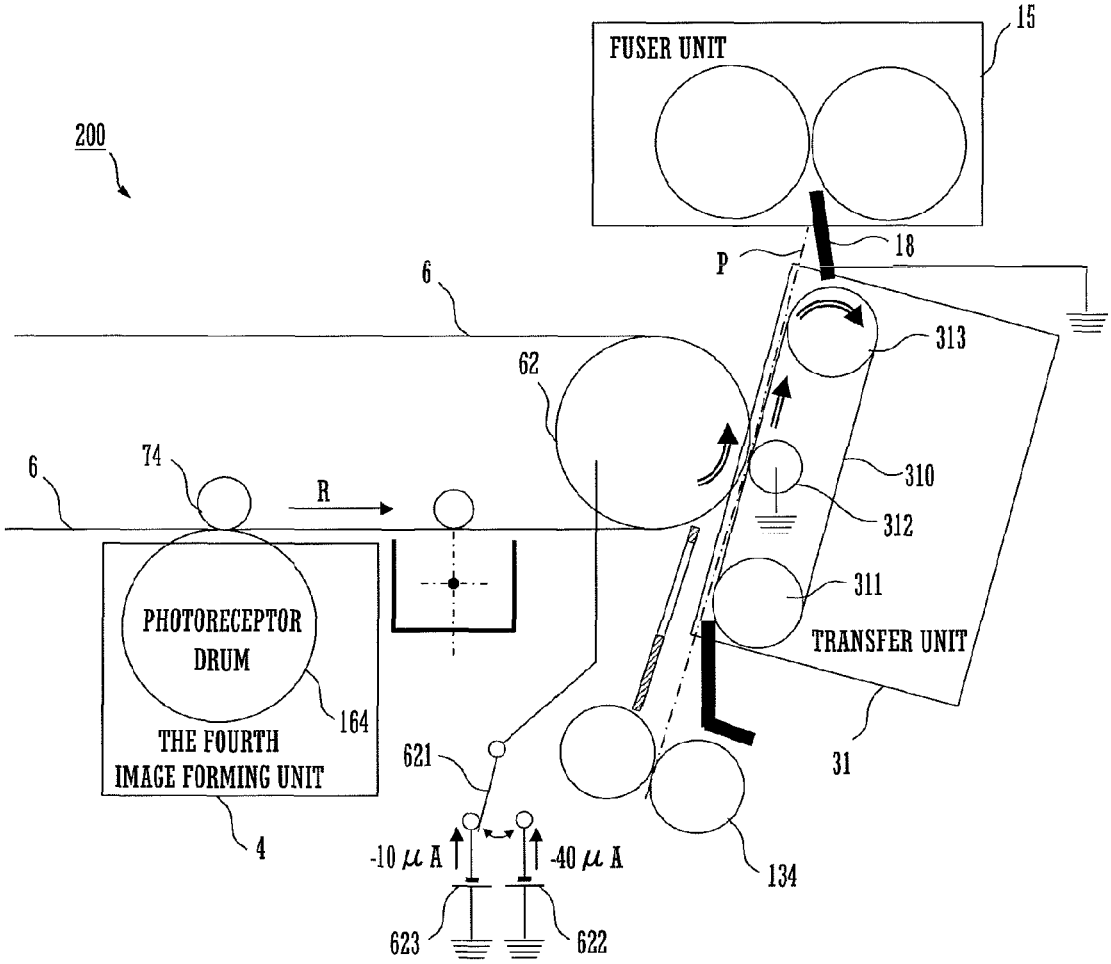
FIG. 2 is a schematic drawing showing a configuration by which a cleaning process is performed on a transfer unit in the image forming apparatus to which the present invention relates.
Figure 3:
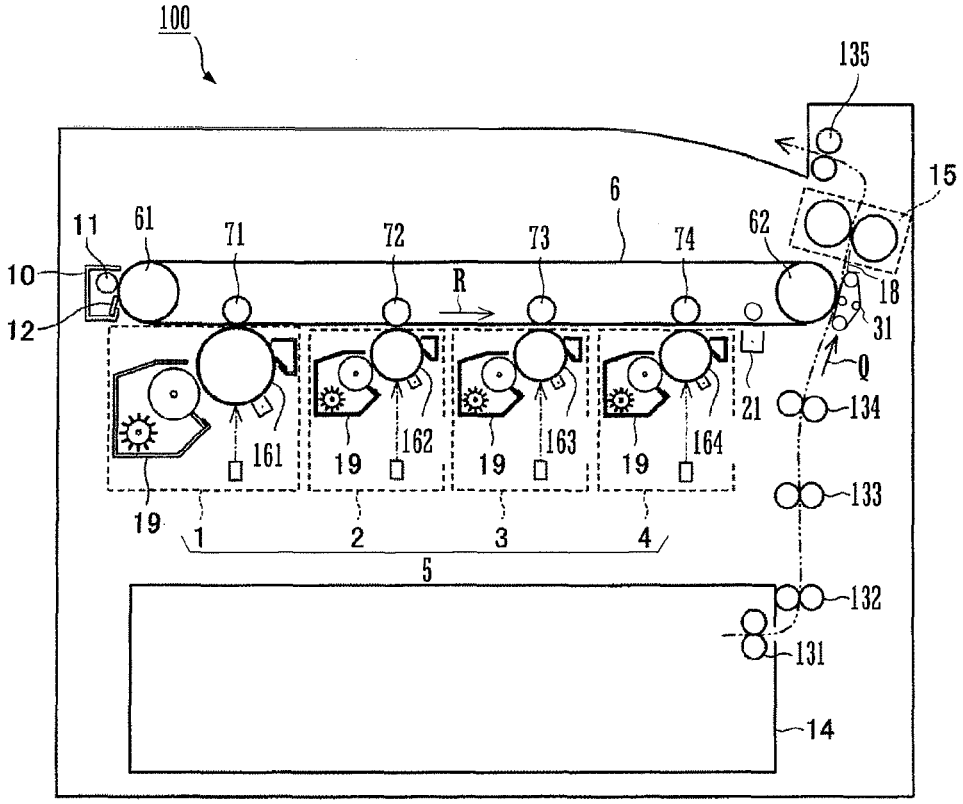
FIG. 3 is a schematic drawing showing a general configuration of an image forming apparatus according to an embodiment of the present invention.

Referring to FIG. 3, a general configuration of a transfer device according to an embodiment of the present invention and an image forming apparatus 100 provided with the transfer device is explained below. Here, in the image forming apparatus 100, the same part thereof as the part of the image forming apparatus 200 shown in FIGS. 1, 2 is denoted by the same sign.

The image forming apparatus 100 is a color image forming apparatus according to the tandem method comprising a first image forming unit 1 for forming a yellow toner image, a second image forming unit 2 for forming a magenta toner image, a third image forming unit 3 for forming a cyan toner image, and a fourth image forming unit 4 for forming a black toner image. Hereinafter, the four image forming units which the image forming apparatus 100 comprises are collectively referred to as the image forming unit group 5.

In FIG. 3, on the upside of the image forming unit group 5 is disposed a primary transfer belt (endless belt) 6. The primary transfer belt 6 is passed over a support roller 61 and the primary transfer belt drive roller 62 in a looped shape in a tensioned condition, and rotates in a direction indicated by an arrow R. For the primary transfer belt 6, one that is made from a resin such as polyimide or polyamide with an electrically conductive material having electronic conductivity being included therein and formed in the shape of a thin film of, for example, 40 μm through 80 μm thick is used.

In the image forming unit group 5 are disposed the first image forming unit 1, the second image forming unit 2, the third image forming unit 3 and the fourth image forming unit 4 in this order along the primary transfer belt 6 in the direction of the arrow R.

On an internal circumference side of the primary transfer belt 6 are disposed primary transfer rollers 71, 72, 73, 74 for respectively transferring, onto the primary transfer belt 6, the single color toner images that are respectively formed by the image forming unit group 5. The primary transfer rollers 71, 72, 73, 74, which the primary transfer belt 6 is passed over in a tensioned condition, are respectively disposed opposed, across the primary transfer belt 6, to photoreceptor drums 161, 162, 163, 164 installed in the image forming unit group 5. The single color toner images that are respectively formed by the image forming unit group 5 are transferred (primary transfer) sequentially onto the primary transfer belt 6 in such a manner as to be superimposed to form a color toner image. The primary transfer belt 6 corresponds to an image bearing member, and conveys the toner image that has undergone a primary transfer to a position (secondary transfer position) at which the primary transfer belt drive roller 62 and a below described secondary transfer unit 31 are opposed to each other. Hereinafter, in the primary transfer belt 6, the support roller 61 side is referred to as the upstream side, and the primary transfer belt drive roller 62 side as the downstream side.

On the downstream side of the fourth image forming unit 4, a secondary pre-transfer electrostatic charger (pre-transfer charger: hereinafter referred to as PTC) 21 is disposed opposed to the primary transfer belt 6. The PTC 21, in order to improve the transfer quality of a color toner image in image forming, gives electric charges of the same polarity as the electrostatic charge polarity of the toner to the color toner image on the primary transfer belt, and thus reduces variations in the quantity of the electrostatic charges of the toner image.

At a position opposed to the primary transfer belt drive roller 62 across the primary transfer belt 6, the secondary transfer unit 31 is disposed. The color toner image that has been formed on the primary transfer belt 6 is transferred onto a paper sheet (corresponding to a recording material) P by an electrostatic force at the secondary transfer position where the primary transfer belt drive roller 62 and the secondary transfer unit 31 are opposed to each other.

At a position opposed to the support roller 61 across the primary transfer belt 6, a primary transfer belt cleaning unit 10 for cleaning a surface of the primary transfer belt 6 is installed. The primary transfer belt cleaning unit 10 includes a belt cleaning brush 11 that is disposed in contact with the primary transfer belt 6 and a belt cleaning blade 12, and removes the toner and the like that remain on the primary transfer belt 6 without being transferred onto the paper sheet P.

In FIG. 3, in the lower part of the image forming unit group 5 is disposed a tray 14 to receive the paper sheet(s) P. The paper sheet P in the tray 14 is conveyed by a plurality of feed rollers 131 through 134 in a direction indicated by an arrow Q to the secondary transfer position at which the secondary transfer unit 31 is opposed to the primary transfer belt 6; and then at the secondary transfer position, the color toner image on the primary transfer belt 6 undergoes a secondary transfer onto the paper sheet P.

Its conveying direction being restricted by a pre-fusing guide member 18 that is installed on the downstream side from the secondary transfer position, the paper sheet P onto which the color toner image has undergone the secondary transfer is conveyed to a fuser unit 15. Then, the paper sheet P, after the color toner image having been fixed thereon by the fuser unit 15, is discharged from the image forming apparatus 100 by a paper discharge roller 135. In the image forming apparatus 100, the secondary transfer unit 31, the pre-fusing guide member 18 and a below mentioned control section 51 correspond to a transfer device.

Figure 4:
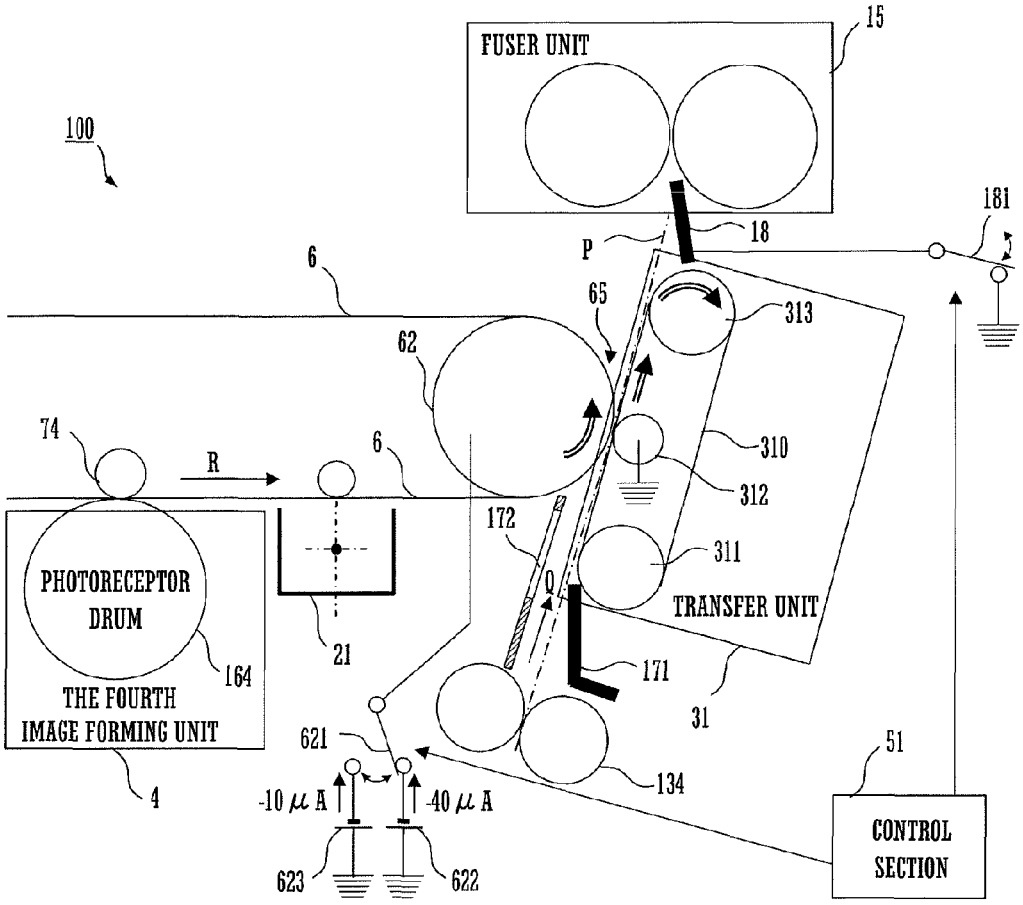
FIG. 4 is a schematic drawing showing a configuration by which a transfer process is performed in the image forming apparatus according to the embodiment of the present invention.
Figure 5:
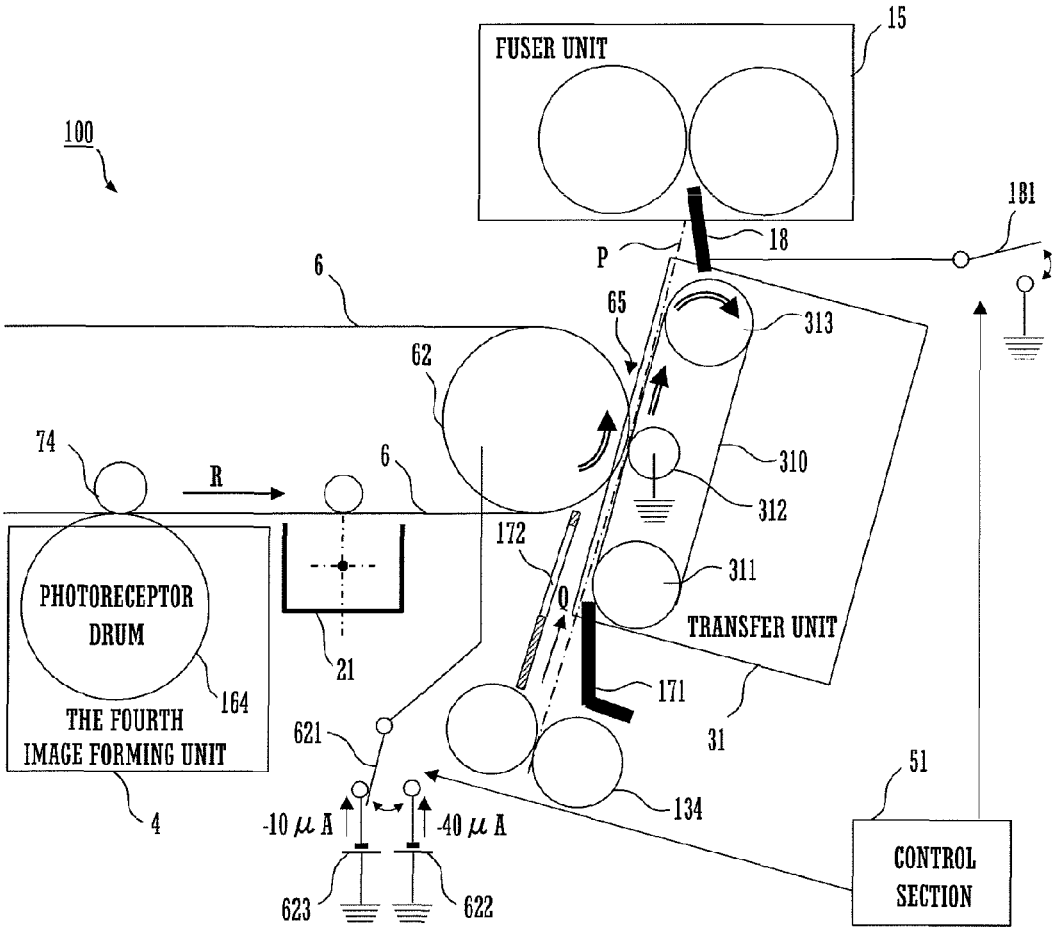
FIG. 5 is a schematic diagram showing a configuration by which a cleaning process is performed on a transfer unit in the image forming apparatus according to the embodiment of the present invention.

Next, a concrete configuration of parts and their peripheries constituting the transfer device is explained. As shown in FIG. 4, the image forming apparatus 100 comprises the feed roller 134, a pre-transfer guide member 171, a pre-transfer guide member 172, the secondary transfer unit 31, the primary transfer belt drive roller 62, the pre-fusing guide member 18 and the fuser unit 15 in this order from the upstream side along the conveying direction Q of the paper sheet P.

The secondary transfer unit 31 includes a secondary transfer belt (endless belt) 310, a support roller 311, a secondary transfer roller 312 and a secondary transfer belt drive roller 313. The secondary transfer belt 310 is passed over the support roller 311 and the secondary transfer belt drive roller 313 in a looped shape in a tensioned condition. The secondary transfer belt drive roller 313 corresponds to a tension roller.

The secondary transfer belt 310 conveys to the secondary transfer position 65 the paper sheet P conveyed by the feed roller 134, and then conveys the paper sheet P further to the fuser unit 15. For a secondary transfer belt 310, as an example, an erastomeric rubber belt that is formed from an erastomeric rubber such as CR, EPDM, or NBR coated with a fluorine system is recommended for use.

The support roller 311 is installed on the upstream side from the secondary transfer position 65 in the conveying direction of the paper sheet P, and is in contact with the secondary transfer belt 310. The support roller 311 is made to be in an electrically floated state (a floating state).

The secondary transfer roller 312 is disposed opposed to the primary transfer belt drive roller 62 across the primary transfer belt 6 and the secondary transfer belt 310. The secondary transfer roller 312 is formed from a resistive material such as medium resistance foamed sponge like EPDM or the like, and is made to be in a grounded state.

The secondary transfer belt drive roller 313 is installed in the vicinity of the pre-fusing guide member 18 on the downstream side from the secondary transfer position 65 in the conveying direction of the paper sheet P, is in contact with the secondary transfer belt 310, and rotationally drives the secondary transfer belt 310. The secondary transfer belt drive roller 313 is made to be in an electrically floated state. For a secondary transfer belt drive roller 313, for example, one such as aluminum pipe to which a shaft core is fixed is recommended for use.

The pre-fusing guide member 18 is installed in the vicinity of the secondary transfer belt drive roller 313, and is connected to a first switch 181.

Here, it is to prevent the occurrence of malfunctions such as ones due to the paper sheet P conveyed by the secondary transfer belt 310 creeping into the backside of the pre-fusing guide member 18 and/or oscillating on transit that the pre-fusing guide member 18 is provided in the vicinity of the secondary transfer belt drive roller 313 for the secondary transfer belt 310. As a distance (a gap) between the secondary transfer belt drive roller 313 and the pre-fusing guide member 18, for example, about 1 mm through 3 mm is recommended to employ.

The switch 181 causes the state of the pre-fusing guide member 18 to be switched between the grounded state and the electrically floated state. The switch 181 is controlled by a control section 51 for controlling each part of the image forming apparatus 100.

The primary transfer belt drive roller 62 is disposed opposed to the secondary transfer roller 312 across the primary transfer belt 6 and the secondary transfer belt 310. The primary transfer belt drive roller 62 is connected to a second switch 621. The switch 621 is connected to a first power supply 622 and a second power supply 623, and is controlled by the control section 51.

The first power supply 622 causes a first electric current (for instance, minus 40 microamperes) to flow from the primary transfer belt drive roller 62 to the secondary transfer roller 312. The second power supply 623 causes a second electric current (for instance, minus 10 microamperes) of which absolute value is smaller than the value in transfer processing to flow from the primary transfer belt drive roller 62 to the secondary transfer roller 312.

Subsequently, operation of the transfer device (image forming apparatus) is explained based on the flow chart shown in FIG. 6. The image forming apparatus 100 performs an image forming process (transfer process) and a cleaning process (non-transfer process) for the secondary transfer belt 310 in the following manner.

Figure 6:
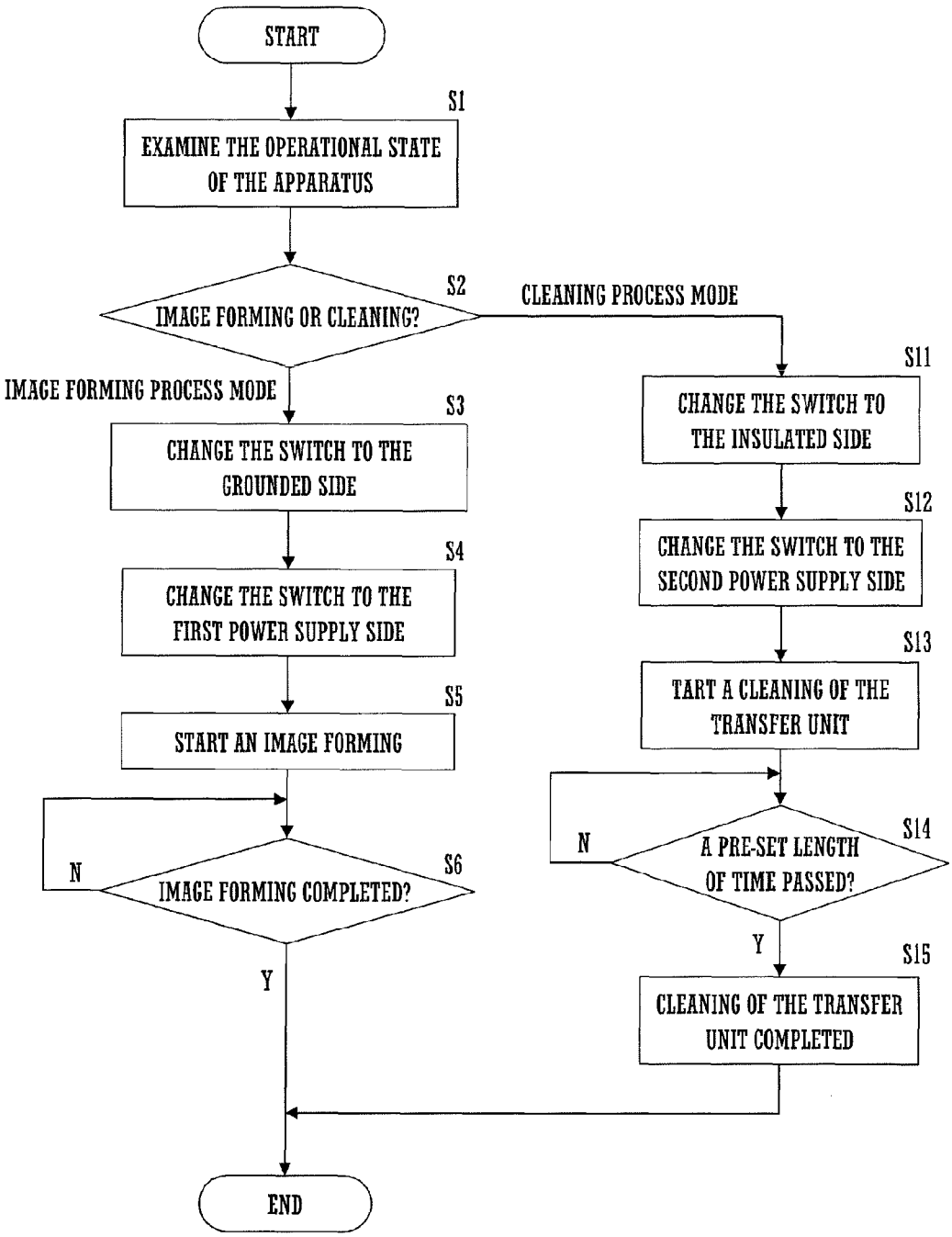
FIG. 6 is a flow chart showing a control procedure for a transfer device in the image forming apparatus according to the embodiment of the present invention.

As shown in FIG. 6, the control section 51 of the image forming apparatus 100 examines operational state (mode) of the main body (S1).

Examining the operational state, if the result thereof shows that the main body is in the image forming process (transfer process) mode (S2), the control section 51 causes the switch 181 to change over to the grounded side so that the pre-fusing guide member 18 is in a grounded state (S3).

Also, the control section 51 makes the switch 621 change over to the first power supply 622 side so that the first electric current (minus 40 microamperes) is caused to flow from the primary transfer belt drive roller 62 to the secondary transfer roller 312 (S4).

Subsequently, the control section 51 starts an image forming process (S5). That is, on forming the toner images in the image forming unit group 5, the control section 51 causes them to undergo a primary transfer onto the primary transfer belt 6. The toner image that has undergone the primary transfer is conveyed by the primary transfer belt 6 to the secondary transfer position 65 at which the primary transfer belt drive roller 62 and the secondary transfer belt 310 of the secondary transfer unit 31 are opposed to each other.

In the image forming apparatus 100, because the first electric current (minus 40 microamperes) flows from the primary transfer belt drive roller 62 to the secondary transfer roller 312 while the toner forming the toner image is electrically charged to negative polarity, the toner image is transferred from the primary transfer belt 6 onto the paper sheet (recording material) P at the secondary transfer position 65 by an electrostatic force. The paper sheet P onto which the toner image has been transferred is conveyed by the secondary transfer belt 310 and the primary transfer belt 6, and is conveyed to the fuser unit 15 with its direction of conveyance being restricted by the pre-fusing guide member 18 on contact therewith. The paper sheet P undergoes a heat fusing of the toner image thereon, and then is discharged outside the apparatus.

At this time, because the secondary transfer belt drive roller 313 is made to be in the electrically floated state, the electrostatic adsorption force acting on the toner toward the paper sheet P does not decrease even when the paper sheet P passes in the neighborhood of the secondary transfer belt drive roller 313; and it is only when the paper sheet P comes into contact with the pre-fusing guide member 18 in the grounded state that the electrostatic adsorption force decreases. Therefore, since decrease of the electrostatic adsorption force acting on the toner toward the paper sheet P is curbed as compared with conventional instances, image deletion will not occur. Additionally, since a voltage on the drive roller 313 measures somewhere about 1.4 kV remaining at a constant voltage as described below, diselectrification does not take place on the part of the drive roller. That is to say, since diselectrification dose not take place successively on the part of the drive roller 313 and on the part of the guide member 18, the phenomenon of picture quality disorder in which the toner moves on the paper sheet P is prevented from occurring.

Figure 7:
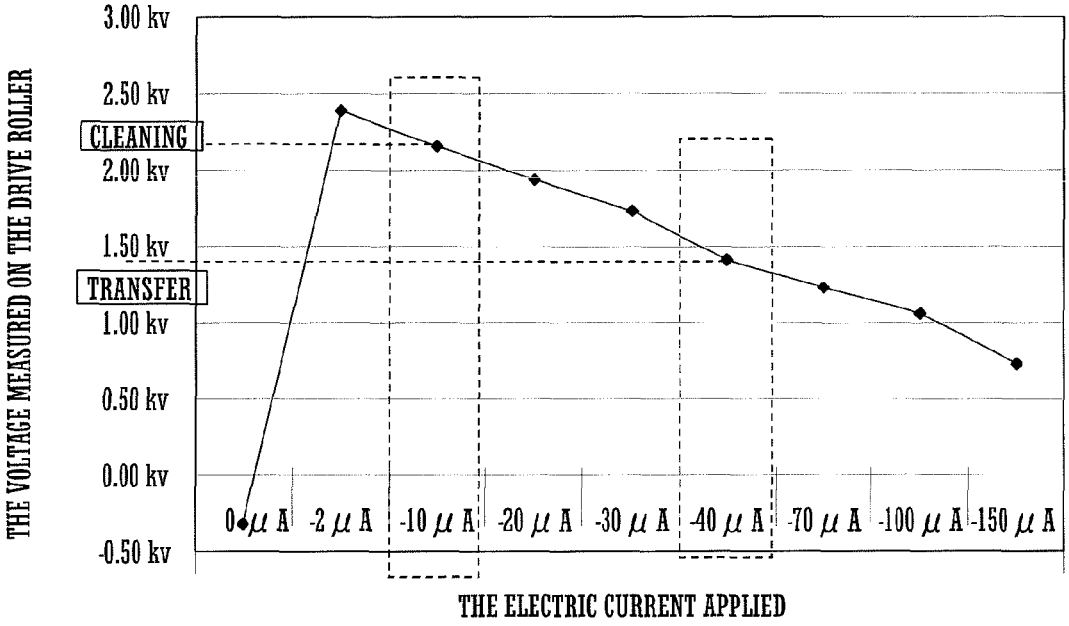
FIG. 7 is a graph showing a relationship between an electric current supplied from a primary transfer belt drive roller and a voltage measured on a secondary transfer belt drive roller in the image forming apparatus according to the embodiment of the present invention.

FIG. 7 shows a relationship between a magnitude of an electric current flowing from the primary transfer belt drive roller 62 to the secondary transfer roller 312 and a voltage measured on the secondary transfer belt drive roller 313. It is thought to be the reason for such a behavior that the electric charges tend to accumulate through the surface of the secondary transfer belt 310 onto the whole belt rather than flowing through the roller 312 to the ground when a low level of electric current such as minus 2 microamperes through minus 10 microamperes is supplied, because the secondary transfer roller 312 has a resistance. On the other hand, when a large electric current to the extent of about minus 40 microamperes is supplied, it gets less likely that the electric charges accumulate onto the whole belt because the electric current flows through the roller 312 to the ground.

For the above mentioned reason, in image forming processing (in transfer processing), when the electric current value is set to minus 40 microamperes, the voltage on the drive roller 313 measures somewhere about 1.4 kV. Because the voltage measured on the drive roller 313 is somewhere about 1.4 kV (relatively not high), the electrical discharge phenomenon (electrical discharge noise) will not occur between the roller 313 and the pre-fusing guide member 18 even when the guide member 18 is grounded.

The control section 51 performs a number of image forming processes depending on the number of times that a user has set (S6: N), and on completion of the image forming, completes a series of processes (S6: Y).

On the other hand, examining the operational state in the step S2, if the result thereof shows that the main body is in the cleaning process mode for the secondary transfer unit 31, the control section 51 causes the switch 181 to change over to an isolated side so that the pre-fusing guide member 18 is in an electrically floated state (S11).

Also, the control section 51 makes the switch 621 change over to the second power supply 623 side so that the second electric current (minus 10 microamperes) of which absolute value is smaller than that of the first electric current (minus 40 microamperes) is caused to flow from the primary transfer belt drive roller 62 to the secondary transfer roller 312 (S12).

The control section 51 starts a cleaning process for the transfer unit (S13). That is, the control section 51 drives the primary transfer belt drive roller 62 to cause unnecessary toner on the secondary transfer belt 310 to adhere onto the primary transfer belt 6 by an electrostatic force, thereby removing the unnecessary toner on the secondary transfer belt 310. Then, the control section removes the toner on the primary transfer belt 6 using the primary transfer belt cleaning unit 10 (depicted in FIG. 3).

In cleaning processing for the secondary transfer unit 31, when the second power supply 623 is connected to the primary transfer belt drive roller 62, the relationship between an electric current flowing from the primary transfer belt drive roller 62 to the secondary transfer roller 312 and a voltage that is applied to the secondary transfer belt drive roller 313 is, as shown in FIG. 7, different from the one in transfer processing. That is to say, in cleaning of the secondary transfer belt 310, the electric current flowing from the primary transfer belt drive roller 62 to the secondary transfer roller 312 is the second electric current (minus 10 microamperes), and then the voltage on the secondary transfer belt drive roller 313 measures about 2.2 kV. It is considered that the reason why the voltage measured on the secondary transfer belt drive roller 313 becomes high to such an extent is because there is little electric current flowing through the secondary transfer roller 312 in cleaning processing due to the secondary transfer roller 312 having a resistance and also due to the secondary transfer belt drive roller 313 caused to be in an electrically floated state, so that electric charges accumulate onto the secondary transfer belt drive roller 313 through the secondary transfer belt 310.

When the voltage measured on the secondary transfer belt drive roller 313 is more than 2.0 kV and when the pre-fusing guide member 18 is grounded, the electrical discharge noise occurs; in this case, however, since the pre-fusing guide member 18 is caused to be in an electrically floated state, the electrical discharge noise will not occur between the secondary transfer belt drive roller 313 and the pre-fusing guide member 18.

The control section 51 continues the cleaning processing for the secondary transfer unit 31 until a pre-set length of time passes (S14: N). The control section 51, on passage of the length of time (S14: Y), finishes the cleaning processing for the secondary transfer unit 31 (S15).

As mentioned above, with the image forming apparatus 100, by preventing the picture quality disorder, the image deletion and/or the electrical discharge from occurring, images of good quality can be formed.

Figure 8:
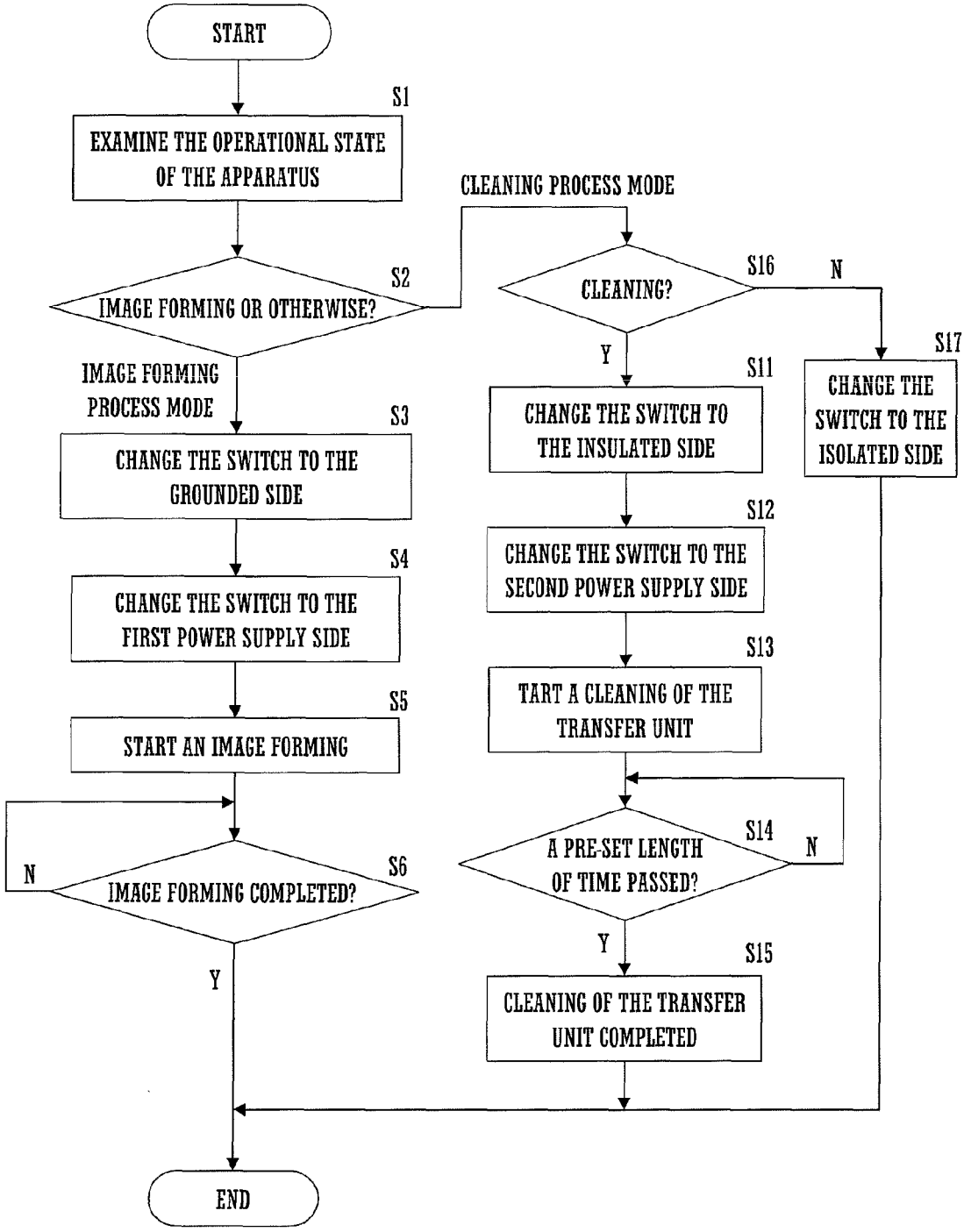
FIG. 8 is a flow chart showing a control procedure for a transfer device in an image forming apparatus according to another embodiment of the present invention.

Further, although, in the above description, explanation has been made on the case where the pre-fusing guide member 18 is switched into an electrically floated state in cleaning processing for the secondary transfer unit 31, the present invention is not limited as such; but when a process other than the transfer process is performed in the image forming apparatus 100, that is, in non-transfer processing, the pre-fusing guide member 18 may be switched into an electrically floated state. FIG. 8 is a flow chart showing an operation of the control section 51 in performing such a control. That is, the control section 51, on judging that the apparatus is in operation for a process other than a transfer process (image forming process) at S2, then judges whether the operation is for a cleaning process or for a non-cleaning process (S16), and performs a control similar to the one shown in FIG. 6 from the step S16 onward if it is the cleaning process, or performs a control to cause the switch 181 to change over to the isolated side if it is a non-cleaning process. In a non-transfer process, because the paper sheet P is not conveyed, electric charges will not accumulate in excess onto the pre-fusing guide member 18; nor will the electrical discharge occur between the secondary transfer belt drive roller 313 and the pre-fusing guide member 18 even if the roller 313 becomes a high voltage.

Moreover, although, in the above description, explanation has been made on the case where the pre-fusing guide member 18 is always held in a grounded state in transfer processing (image forming), the present invention is not limited as such; but the pre-fusing guide member 18 may, for instance, be switched between a grounded state and an electrically floated state as described in the Japanese Patent Unexamined Publication No. 2007-94343 bulletin. That is, in image forming, it may be acceptable for the control section 51 to cause the pre-fusing guide member 18 to be in an electrically floated state when there is a paper sheet P on the pre-fusing guide member 18, or to cause the pre-fusing guide member 18 to be in either an electrically floated state or a grounded state based on the printing conditions (number of sheets, temperature and humidity around the photoreceptor) when there is no paper sheet P on the pre-fusing guide member 18. Doing this way can also curve the occurrence of the pre-fusing picture quality disorder.

Further, among the image forming apparatus is known the one that does not comprises a primary transfer belt but comprises a transfer device that is provided with a transfer unit with a transfer device thereof installed opposed to a photoreceptor body (image bearing body) of an image forming unit for transferring the toner image that has been formed on the photoreceptor body (image bearing body) of the image forming unit directly onto a paper sheet P at a transfer position by an electrostatic force; naturally, however, the present invention is also applicable to such a transfer device and/or an image forming apparatus.

In addition, in cleaning processing, in a case where the ability for cleaning the secondary transfer belt 310 deteriorates, it is recommended to cause the switch 621 to change over in such a manner as to be connected alternately to the second power supply 623 and to a grounded terminal which is not illustrated. Besides, it is recommended to provide a third power supply, which is not illustrated, in order to cause an electric current of, for example, plus 10 microamperes (an electric current of which absolute value is smaller than that of the first electric current) to flow between the primary transfer belt drive roller 62 and the secondary transfer roller 312, and to cause the switch 621 to change over in such a manner as to be connected to the second power supply 623 and to the third power supply alternately. Although there arises a risk that the fog toner is charged again by the electric current flowing in cleaning processing and hence that it will not adhere to the primary transfer belt 6, the toner sticking to the secondary transfer belt 310 can be cleaned surely by changing the electric current value as described above.

Furthermore, although an example has been explained in the above in which minus 40 microamperes as the first electric current and minus 10 microamperes as the second electric current are caused to flow respectively, the present invention is not limited as such. That is, it is sufficient that the first electric current is set such that the secondary transfer can be performed surely and such that the voltage measured on the secondary transfer belt drive roller 313 in an electrically floated state against the grounded pre-fusing guide member 18 is at a value (less than 2.0 kV) at which the electrical discharge thereto will not occur. In addition, it is sufficient that the second electric current is set such that the secondary transfer belt 310 can be cleaned surely and such that the voltage measured on the secondary transfer belt drive roller 313 in an electrically floated state against the grounded pre-fusing guide member 18 is at a value (greater than 2.0 kV) at which the electrical discharge thereto occurs.

What is claimed is:

1. A transfer device comprising:

a transfer unit including:

a transfer belt for conveying a recording material onto which a toner image is transferred from an image bearing member, a transfer roller formed from a resistive material and disposed opposed to the image bearing member across the transfer belt, the transfer roller being in a grounded state in order to cause an electric current to flow from the transfer belt into the transfer roller, and a tension roller over which the transfer belt is passed in a tensioned condition, the tension roller being in an electrically floated state;

a guide member installed in the vicinity of the tension roller for restricting a conveying direction of the recording material conveyed by the transfer belt;

a first switch for causing the state of the guide member to switch between a grounded state and an electrically floated state;

a second switch for causing an electric current being made to flow from a power supply section to the transfer roller to switch between a first electric current and a second electric current of which absolute value is smaller than that of the first electric current; and a control section for controlling the first switch and the second switch depending on a transfer process in which a toner image is transferred from the image bearing member onto the recording material or a cleaning process in which residual toner that is sticking to the transfer belt is caused to adhere onto the image bearing member for its removal, wherein the control section, in the transfer process, controls the first switch so that the guide member is in the grounded state while controlling the second switch so that an electric current being caused to flow to the transfer roller becomes the first electric current; and, in the cleaning process, controls the first switch so that the guide member is in the electrically floated state while controlling the second switch so that an electric current being caused to flow to the transfer roller becomes the second electric current.

2. The transfer device as claimed in claim 1 wherein the image bearing member is another transfer belt on which the toner image is primarily formed.

3. The transfer device as claimed in claim 1, wherein the first electric current is an electric current of a magnitude enough to transfer the toner image from the image bearing member onto the recording material; and the second electric current is an electric current of a magnitude required to cause the residual toner sticking to the transfer belt to adhere onto the image bearing member and thereby to be removed.

4. The transfer device as claimed in claim 1 wherein a distance between the guide member and the tension roller is set to an extent of 1 mm to 3 mm.

5. The transfer device as claimed in claim 1, wherein the control section controls the first switch so that the guide member is in the electrically floated state in a non-transfer process that includes the cleaning process; and controls the second switch so that an electric current being caused to flow to the transfer roller becomes the second electric current in the cleaning process.

6. An image forming apparatus comprising:

an image forming unit for forming the toner image on the image bearing member;

the transfer device as claimed in claim 1; and a fuser unit for fusing and fixing a toner image transferred onto the recording material by the transfer device.

* * * * *